United States Patent [19]

Harbauer et al.

[11] 4,447,794

[45] May 8, 1984

[54] AIR BREAK CONTACTOR WITH FORM-FITTED PARTS

[75] Inventors: Werner Harbauer; Johann Drexler, both of Schwandorf; Erwin Flierl, Kümmersbruck, all of Fed. Rep. of Germany

[73] Assignee: Siemens Aktiengesellschaft, Munich, Fed. Rep. of Germany

[21] Appl. No.: 473,997

[22] Filed: Mar. 10, 1983

[30] Foreign Application Priority Data

Mar. 22, 1982 [DE] Fed. Rep. of Germany ..... 3210447

[51] Int. Cl.[3] ..... H01H 67/02

[52] U.S. Cl. ..... 335/128; 335/202; 335/203

[58] Field of Search ..... 335/128, 129, 202, 203, 335/245, 276, 279, 281

[56] References Cited

U.S. PATENT DOCUMENTS

| | | | |
|---|---|---|---|
| 3,958,198 | 5/1976 | Minks | 335/203 X |
| 4,321,569 | 3/1982 | Bernier | 335/202 |
| 4,398,165 | 8/1983 | Iketani | 335/202 |

FOREIGN PATENT DOCUMENTS

| | | | |
|---|---|---|---|
| 2626752 | 12/1977 | Fed. Rep. of Germany | 335/128 |

*Primary Examiner*—George Harris

*Attorney, Agent, or Firm*—Kenyon & Kenyon

[57] ABSTRACT

In an air break contactor, the armature comprises a first lamination and two second laminations, the first lamination having at a lower end an extension projecting at a 90° angle with respect to the body of the lamination into a space between the bottom wall of the housing and the free end of a lower leg of the magnet assembly core member. The entire armature rests on an elbow of the lamination extension, while the second laminations are disposed between a pair of tabs extending from respective lateral edges of the first lamination.

20 Claims, 5 Drawing Figures

AIR BREAK CONTACTOR WITH FORM-FITTED PARTS

BACKGROUND OF THE INVENTION

This invention relatesto an air break contactor or air gap relay with form fitted components.

In one kind of air break contactor, an armature and a magnet assembly are inserted, during manufacture, into a cup-shaped housing in a directionperpendicular to the direction of armature motion during operation of the completed contactor. One end of the armature engages a leg of a magnet assembly core member, while an opposite end of the armature is engageable with a contact carrier for shifting the same upon an energization of the coil of the magnet assembly.

As described in German patent document Ser. No. 1,133,010, one contactor of the above-mentioned type has a contact carrier with an extension shiftable between the bottom housing wall and the actuating coil, this extension being operatively connected to the armature via a ball (or roller) and socket joint. This form fitted joint can disadvantageously result in jamming if the contact carrier is shifted. In addition, the magnet assembly core member in this air break contactor is held in the housing by a screw.

An object of the present invention is to provide an improved air break contactor with form fitted components, in which assembly is simplified and in which the probability of armature jamming is substantially reduced if not totally eliminated.

SUMMARY OF THE INVENTION

In the air break contactor or air gap relay according to the present invention, the armature comprises a plurality of plates or laminations, the lamination engaging the magnet assembly core member being provided with an extension projecting between a wall of the housing and a free end of a core member leg at an angle, preferably a right angle, with respect to this first lamination. The extension is joined to the first lamination via a curved profile or elbow which serves as the support point for the entire armature. In such an air break contactor, a relatively long mechanical service life is obtained without the necessity of providing special treatment for the support points. In the sliding or rolling-off region, there are no stamping edges and the contactor can be used with the same armature for d-c and a-c operation. Riveting or otherwise fastening the individual laminations to each other can be avoided if tabs which extend in a direction opposite the magnet assembly and which accept the additional laminations between them are joined to the lateral edges of the first lamination, the tabs being planar and perpendicular to the body of the first lamination and to the extension thereof. The tabs can also serve advantageously for holding biasing or compression springs. A fastening screw for the core member of the magnet assembly can be omitted if the core member leg engaging the housing wall is held in the housing via equalizing ribs and arrests. Separatefastening means for a pole plate or a short circuit ring can be omitted if the pole plate or short circuit ring is mounted on the other core member leg and held there by a projection in the housing.

BRIEF DESCRIPTION OF THE DRAWING

FIG. 6 is a partial longitudinal cross-sectional view, similar to FIG. 1, showing a modification of the contactor of FIG. 1.

DETAILED DESCRIPTION

Figure 1:
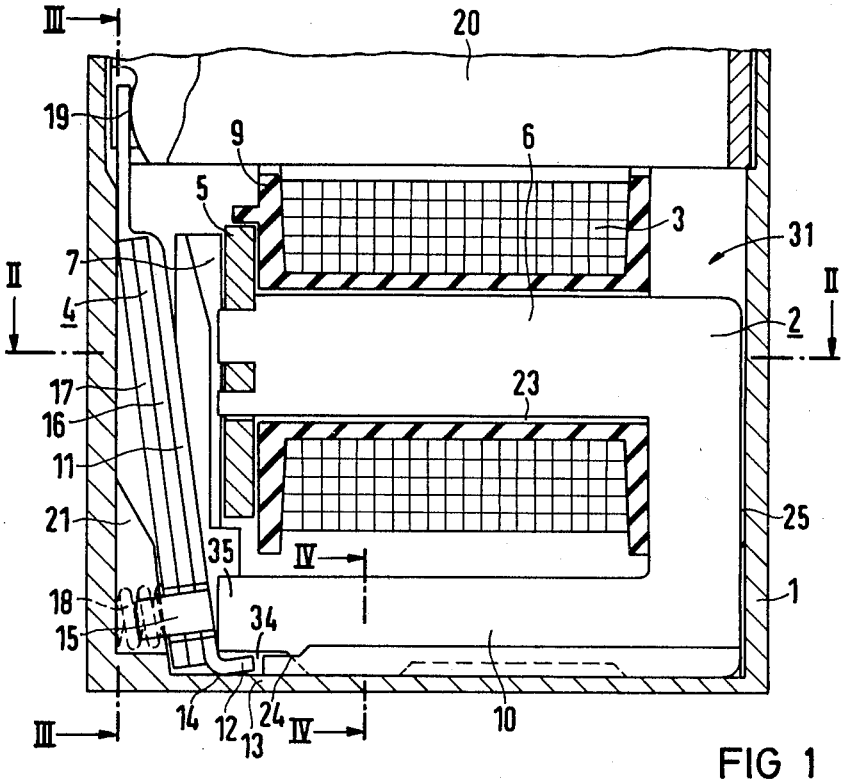
FIG. 1 is a partially schematic longitudinal cross-sectional view of an air break contactor bearing improvements in accordance with the present invention, showing an armature in a "relay switched off" position.
Figure 2:
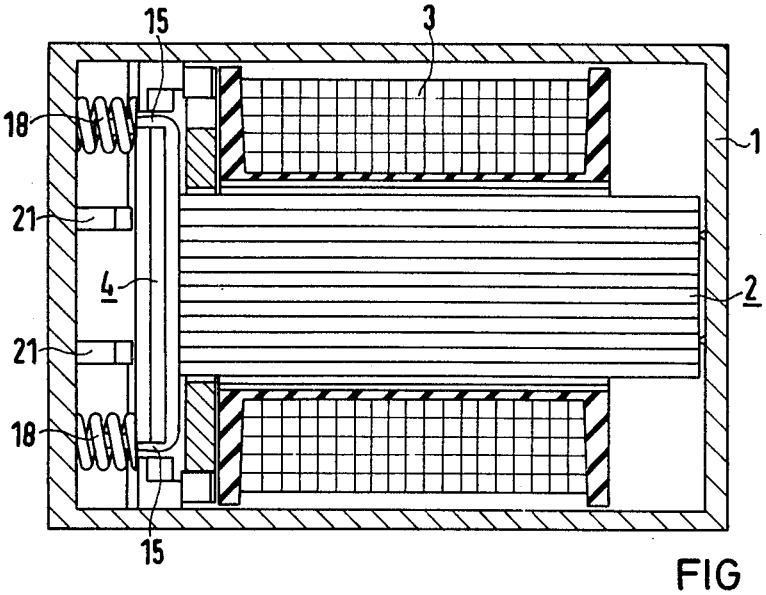
FIG. 2 is a horizontal cross-sectional view taken along line II—II in FIG. 1, showing the armature of FIG. 1 in a "relay switched on" position.

As illustrated in FIGS. 1 and 2, an air break contactor or air gap relay bearing improvements in accordance with the invention comprises a cup-shaped housing 1, an armature 4 pivotable with respect to the housing and a magnet assembly 31 stationary with respect to the housing. The magnet assembly includes a fork-shaped core member 2, an actuating or energizing coil 3 with a coil form or carrier 9 and a pole plate 5. Coremember 2 has a lower leg 10 extending longitudinally in housing 1 and seated in at least one recess 32 (see FIG. 4) formed in a bottom wall 13 of housing 1. Coil 3 and its carrier spool 9 is mounted on and surrounding an upper leg 6 of core number 2, the coil being held on leg 6 by means of pole plate 5. Plate 5 is partially inserted into slots at the free end of leg 6 and is braced, on a side opposite core member 2, by a projection 7 of housing 1.

In accordance with the present invention, armature 4 comprises three laminations or plates 11, 16 and 17. A free end 19 of lamination 17 engages a contact carrier 20 provided with restoring springs (not illustrated), as disclosed in German patent document Ser. No. 1,133,010, for returning armature 4 to the "relay switched off" position shown in FIG. 1. Lamination 11 is formed at a lower end with an extension 12 lying for themost part, in particular at a side spaced from lamination 11, in a plane oriented perpendicularly to the body of lamination 11. Extension 12 is integral with lamination 11 and is advantageously formed by bending the lower end thereof. The extension thus has a curved profile or elbow 14 proximate to the body of lamination 11, this elbow serving as the support point for the entire armature 4.

Figure 3:
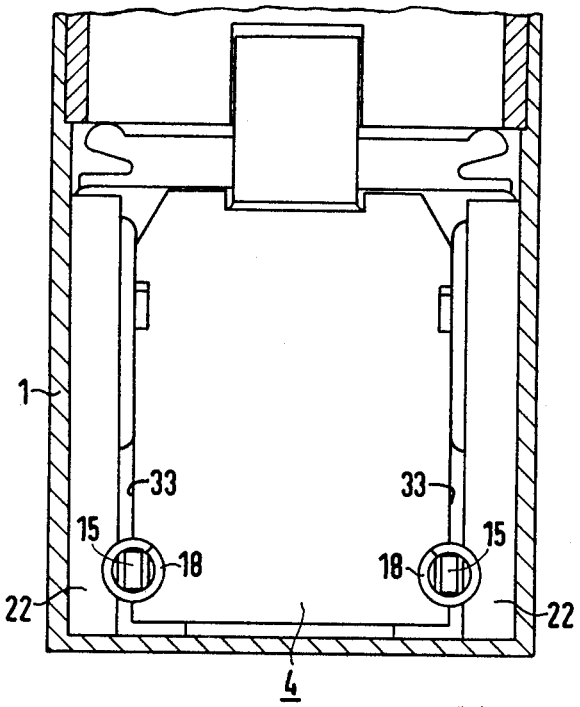
FIG. 3 is a transverse cross-sectional view taken along line III—III in FIG. 1.
Figure 5:
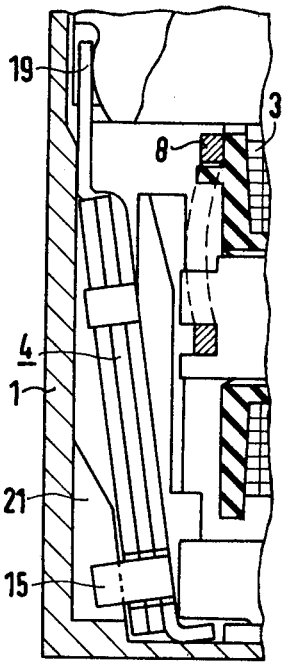

Lamination 11 is provided with a pair of flat tabs 15 extending perpendicularly to lamination 11 and the planar portion of extension 12. Tabs 15 are joined to lamination 11 at respective lateral edges 33 thereof (See FIG. 3) and function in part to restrain laminations 16 and 17 from lateral motion relative to lamination 11. Tabs 15 also serve to hold in position respective springs 18 which are compressed between housing 1 and lamination 17 for maintaining engagement of lamination 11 with core member leg 10 at an elongate contact or pivot area extending the width of leg 10. Upon energization of coil 3, armature 4 pivots about the contact area from the "off" position illustrated in FIG. 1 to the "on" position illustrated in FIG. 2. It is to be noted that, in both the "on" and the "off" positions, extension 12 of laminations 11 projects into a space 34 between the free end 35 of leg 10 and housing wall 13.

Armature 4 is restrained in its motion in all directions. Elbow 14 is supported at housing wall 13. Displacement of the lower parts of laminations 11, 16 and 17 in the longitudinal direction is restrained on the one side by leg 10 at the pivot area (and also, possibly, by extension 12) and on the other side by compression springs 18 and a pair of substantially vertical housing ribs 21 (see FIGS. 1 and 2). Transverse displacement of armature 4 is checked by another pair of vertical housing ribs 22 (see FIG. 3) disposed in a transverse plane. Due to the fact that there is no form fitted connection between the armature 4 and the contact carrier 20 in any direction, the contact carrier can adapt in its motion more easily to the corresponding displacement track.

Figure 4:
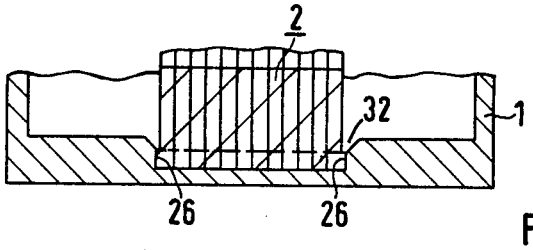
FIG. 4 is a partial transverse cross-sectional view taken along line IV—IV in FIG. 1.

In addition to armature 4, other components of an air break contactor according to this invention are form fitted to each other to prevent undue relative motion. Coil 3 is held in a close fit by means of equalizing ribs 23 in the coil carrier 9 (see FIG. 1). Longitudinal displacement of core member 2 is prevented on the one side by an equalizing rib 25 in housing 1 and on the other side by pole plate 5 or short circuit ring 8 and housing projection 7. Transverse motion of the magnet assembly core member is checked by a pair of guide stops 26 formed as parallel sides of recess 32, as shown in FIG. 4.

During the assembly of an air break contactor in accordance with the present invention, coil 3 and carrier 9 are slipped onto leg 6 of core member 2. Pole plate 5 or short circuit ring 8 is positioned and subsequently the complete magnet assembly 31 and armature 4 optionally with biasing springs 18 are guided into housing 1 and secured via the above-described arrests. Assembly is thus relatively simple. Moreover, essentially the same parts are used for a-c applications and for d-c applications, with the exception of short circuit ring 8 (for a-c) and pole plate 5 (for d-c). No additional fastening means such as peening-over, bolting or welding are required for the short circuit ring or the pole plate. The improvements according to this invention are particularly useful in small contactors.

What is claimed is:

1. In an air break contactor comprising a cup-shaped housing, a contact carrier and form-fitted contactimplementing parts contained in said housing, said contactimplementing parts including a pivotable armature and a magent assembly stationary with respect to said housing, said magnet assembly having a core member with a first leg engaging a wall of said housing and with a second leg parallel to said first leg and an actuating coil mounted on and at least partially surrounding said second leg, said armature having one end continuously engaging a free end of said first leg at a pivot area and an opposite end engageable with said contact carrier for shifting the carrier upon energization of said coil and consequent pivoting of said armature, the improvement wherein:

the free end of the first leg of the magnet assembly core member is spaced from the housing wall;

the armature comprises a first lamination and at least one second lamination, said first lamination engaging said first leg at the pivot area; and said first lamination is provided at an end juxtaposed to said first leg with an extension projecting between said housing wall and said free end of said first leg at an angle with respect to said first lamination, said extension having a curved profile proximate to said first lamination.

2. The improvement defined in claim 1 wherein said first lamination has at least two tabs extending perpendicularly thereto from respective lateral edges of said first lamination in a direction substantially opposite the magnet assembly, said second lamination being disposed between said tabs, whereby lateral motion of said second lamination relative to said first lamination is restrained.

3. The improvement defined in claim 2 wherein said extension has a planar portion spaced from said first lamination and lying in a first plane perpendicular thereto, and said tabs are flat and are disposed in respective second planes oriented perpendicularly to said first plane.

4. The improvement defined in claim 3 wherein biasing means including at least one spring is disposed between the housing and said armature at least in part for maintaining the engagement of said first lamination with said first leg at said pivot area.

5. The improvement defined in claim 4 wherein said biasing means includes a pair of springs held in position at least in part by said tabs.

6. The improvement defined in claim 5 wherein said pair of springs is a pair of coils and said tabs extend longitudinally through said coils.

7. The improvement defined in claim 6 wherein said housing is provided with arresting means for restraining motion of said core member relative to said housing.

8. The improvement defined in claim 7 wherein said arresting means includes a rib.

9. The improvement defined in claim 7 wherein said housing wall is provided with a recess and said first leg of said core member is seated in said recess, said recess having sides forming part of said arresting means.

10. The improvement defined in claim 7 wherein said magnet assembly is provided with stopping means for restraining motion of the actuating coil relative to said core member.

11. The improvement defined in claim 10 wherein said stopping means includes a pole plate engaging said housing and the second leg of said core member.

12. The improvement defined in claim 10 wherein said stopping means includes a short circuit ring engaging said housing and the second leg of said core member.

13. The improvement defined in claim 1 wherein said housing wall is provided with a recess with at least two sides and said first leg of said core member is seated in said recess, the housing being provided with arresting means including a rib and the sides of said recess for checking motion of said core member relative to said housing.

14. The improvement defined in claim 13 wherein the magnet assembly is provided with stopping means, including a pole plate engaging said housing and the second leg of said core member, for checking motion of the actuating coil relative to said core member.

15. The improvement defined in claim 13 wherein the magnet assembly is provided with stopping means, including a short circuit ring engaging said housing and the second leg of said core member, for checking motion of the actuating coil relative to said core member.

16. The improvement defined in claim 3 wherein said housing wall is provided with a recess with at least two sides and said first leg of said core member is seated in said recess, the housing being provided with arresting means including a rib and the sides of said recess for checking motion of said core member relative to said housing.

17. The improvement defined in claim 16 wherein said magnet assembly is provided with stopping means, including a pole plate engaging said housing and the second leg of said core member, for checking motion of the actuating coil relative to said core member.

18. The improvement defined in claim 16 wherein said magnet assembly is provided with stopping means, including a short circuit ring engaging said housing and the second leg of said core member, for checking motion of the actuating coil relative to said core member.

19. The improvement defined in claim 5 wherein said housing wall is provided with a recess with at least two sides and said first leg of said core member is seated in said recess, the housing being provided with arresting means including a rib and the sides of said recess for checking motion of said core member relative to said housing.

20. The improvement defined in claim 19 wherein said magnet assembly is provided with stopping means engaging said housing and the second leg of said core member for restraining motion of the actuating coil relative to said core member.

* * * * *